US005495735A

United States Patent [19]

Nishimura

[11] Patent Number: 5,495,735

[45] Date of Patent: Mar. 5, 1996

[54] SYSTEM FOR CONTROLLING STRIP THICKNESS IN ROLLING MILLS

[75] Inventor: Yoichi Nishimura, Tokyo, Japan

[73] Assignee: Kabushiki Kaisha Toshiba, Kanagawa, Japan

[21] Appl. No.: 317,824

[22] Filed: Oct. 4, 1994

Related U.S. Application Data

[63] Continuation of Ser. No. 2,571, Jan. 27, 1993, abandoned.

[30] Foreign Application Priority Data

Jan. 28, 1992 [JP] Japan ..... 4-013116

[51] Int. Cl.[6] ..... B21B 37/02

[52] U.S. Cl. ..... 72/8.2; 72/11.8; 72/16.4; 72/8.4

[58] Field of Search ..... 72/8, 11, 16, 234, 72/12, 10

[56] References Cited

U.S. PATENT DOCUMENTS 4,460,852 7/1984 Kondo et al. ..... 72/8

FOREIGN PATENT DOCUMENTS 0084718 4/1988 Japan ..... 72/16
0092411 4/1990 Japan ..... 72/234
0047613 2/1991 Japan ..... 72/16

*Primary Examiner*—Lowell A. Larson
*Assistant Examiner*—Thomas C. Schoeffler
*Attorney, Agent, or Firm*—Finnegan, Henderson, Farabow, Garrett & Dunner

[57] ABSTRACT

A system for controlling a thickness of a strip being rolled by a rolling mill having more than two rolling stands, in tandem configuration. A subcontrol unit controls a rolling speed and a rolling load of a final rolling stand according to a predetermined control schedule. A plurality of tension gauge units installed between adjacent rolling stands detect a tension of the strip. A plurality of thickness gauge units including at least first thickness gauge unit installed on the output side of a first rolling stand, second thickness gauge unit installed on the output side of a penultimate rolling stand, and final thickness gauge unit installed on the output side of the final rolling stand, detect a deviation in the thickness of the strip from a predetermined value. A thickness control unit, connected to the tension gauge units and the thickness gauge units, controls the thickness and the tension of the strip to respective predetermined values by adjusting a roll gap and the rolling speed of the rolling stands except the final rolling stand, based on the detected tensions and the detected deviations of the strip. A feedback unit controls a rolling speed of an antepenultimate rolling stand according to the detected deviation of the last thickness gauge unit and the detected deviation of the second thickness gauge unit to adjust the thickness of the strip to the predetermined value.

2 Claims, 2 Drawing Sheets

SYSTEM FOR CONTROLLING STRIP THICKNESS IN ROLLING MILLS

This application is a continuation of application Ser. No. 08/002,571, filed Jan. 27, 1993, now abandoned.

BACKGROUND OF THE INVENTION

This invention relates to a system for controlling a rolling mill, and more particularly to a system for controlling the thickness of a strip being rolled by the rolling mill.

FIG. 1 shows one conventional control system for controlling the thickness of a strip being rolled by a rolling mill, together with the arrangement of rolling stands. In FIG. 1, rolling stands 11–15 (rolling stand 15 is hereinafter referred to as the final rolling stand) are arranged in tandem configuration. A strip is being rolled in the direction of the arrow x. The work-rolls of each of rolling stands 11–14 are bright rolls with smooth surfaces, but that of the final rolling stand is a matt roll with high surface roughness. Rolling with this sort of arrangement of rolls is called matt rolling.

In the abovementioned conventional control system for controlling the strip thickness, be it directly or indirectly, the deviation in thickness of the strip 1 on the output side of each of rolling stands 11, 12, 13 and 15 vis-a-vis the desired thickness is determined, and the roll gap or roll speed is controlled in such a manner that this deviation approximates to zero. However, there is no feedback control with regard to deviation in the thickness of the strip on the output side of Polling stand 14, i.e. on the input side of the final rolling stand 15.

For this reason, it is impossible to control any variation in strip thickness which occurs on the input side of the final rolling stand 15 until variation in the strip thickness on the output side of the final rolling stand 15 occurring as a result of this variation (variation in finished strip thickness) is detected by the thickness gauge 65, and this results in variation in the finished strip thickness. Moreover, since the variation in the finished strip thickness is controlled by adjusting the rolling speed of the antepenultimate rolling stand 13, which is located more upstream than the stand 14 adjacent to the stand 15, speedy control response to the variation is not feasible.

When the work rolls of the rolling stands in tandem configuration are all bright rolls, the tension of the strip between the final rolling stand and the penultimate rolling stand is maintained constant by feeding the amount by which the roll gap is to be corrected to a hydraulic device for controlling a roll gap of the final rolling stand. In matt rolling, however, where the work roll of the final rolling stand is a matt roll, it is necessary to maintain the rolling load and rolling speed of the final rolling stand at an initially predetermined value in accordance with the rolling schedule. Conventionally, the rolling speed of the penultimate rolling stand is corrected in such a manner that the detected tensile value on the input side of the final rolling stand accords with the desired tensile value.

Thus, in matt rolling, it is further necessary to correct the rolling speed of the antepenultimate rolling stand vis-a-vis correction of the deviation in strip thickness on the output side of the final rolling stand. As a result of this it is impossible to control the deviation in strip thickness on the input side of the final rolling stand because the amount by which the rolling speed is to be corrected is being fed to the motor drivers of all the rolling stands with the exception of the final one.

THE SUMMARY OF THE INVENTION

It is an object of the invention to improve controllability of a thickness of a strip being rolled by a rolling mill.

Another object is to make it possible to improve control response to suppress variation in the thickness of the finished strip.

Additional objects and advantages will be obvious from the description which follows, or may be learned by practice of the invention.

The foregoing objects are achieved according to the present invention by providing a system fop controlling a thickness of a strip being rolled by a rolling mill having more than two rolling stands, in tandem configuration, comprising: subcontrol means for controlling a rolling speed and a rolling load of a final rolling stand according to a predetermined control schedule; a plurality of tension gauge means installed between adjacent rolling stands for detecting a tension of the strip; a plurality of thickness gauge means including at least first thickness gauge means installed on the output side of a first rolling stand, second thickness gauge means installed on the output side of a penultimate rolling stand, and final thickness gauge means installed on the output side of the final rolling stand, for detecting a deviation in the thickness of the strip from a predetermined value; and thickness control means, connected to the tension gauge means and the thickness gauge means, for controlling the thickness and the tension of the strip to respective predetermined values by adjusting a roll gap and the rolling speed of the rolling stands except the final rolling stand, based on the detected tensions and the detected deviations of the strip, thickness control means including feedback means for controlling a rolling speed of an antepenultimate rolling stand according to the detected deviation of the last thickness gauge means and the detected deviation of the second thickness gauge means to adjust the thickness of the strip to the predetermined value.

According to another aspect of the invention, the above objects are acheived by providing a method for controlling a thickness of a strip being rolled by a rolling mill having more than two rolling stands in tandem configuration, comprising the steps of: controlling a rolling speed and a rolling load of a final rolling stand according to a predetermined control schedule; detecting a tension of the strip between adjacent rolling stands; detecting a deviation in the thickness of the strip from a predetermined value at least on the output side of a first rolling stand, on the output side of a penultimate rolling stand, and on the output side of the final rolling stand; controlling the thickness and the tension of the strip to respective predetermined values by adjusting a roll gap and the rolling speed of each of the rolling stands except the final rolling stand, based on the detected tensions and the detected deviations of the strip; and controlling a rolling speed of an antepenultimate rolling stand according to the detected deviation on the output side of the last rolling stand and the detected deviation on the output side of the penultimate rolling stand to adjust the thickness of the strip to the predetermined value.

Other objects, features, and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Figure 1:
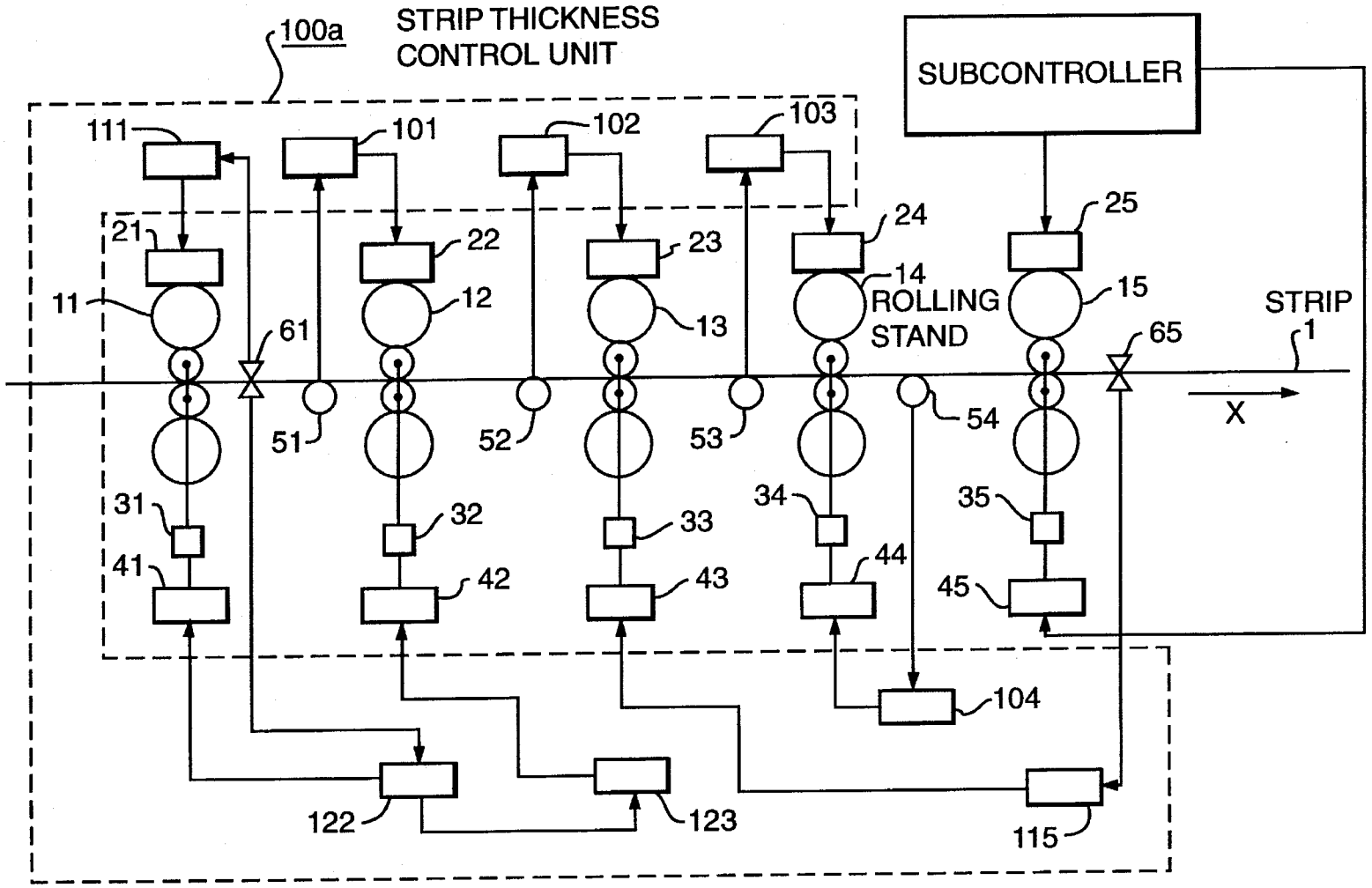
FIG. 1 PRIOR ART
FIG. 1 is a block diagram showing a conventional control system for controlling a thickness of a strip being rolled by a rolling mill.

The following is a detailed description of an embodiment of the present invention with reference to the drawing.

Figure 2:
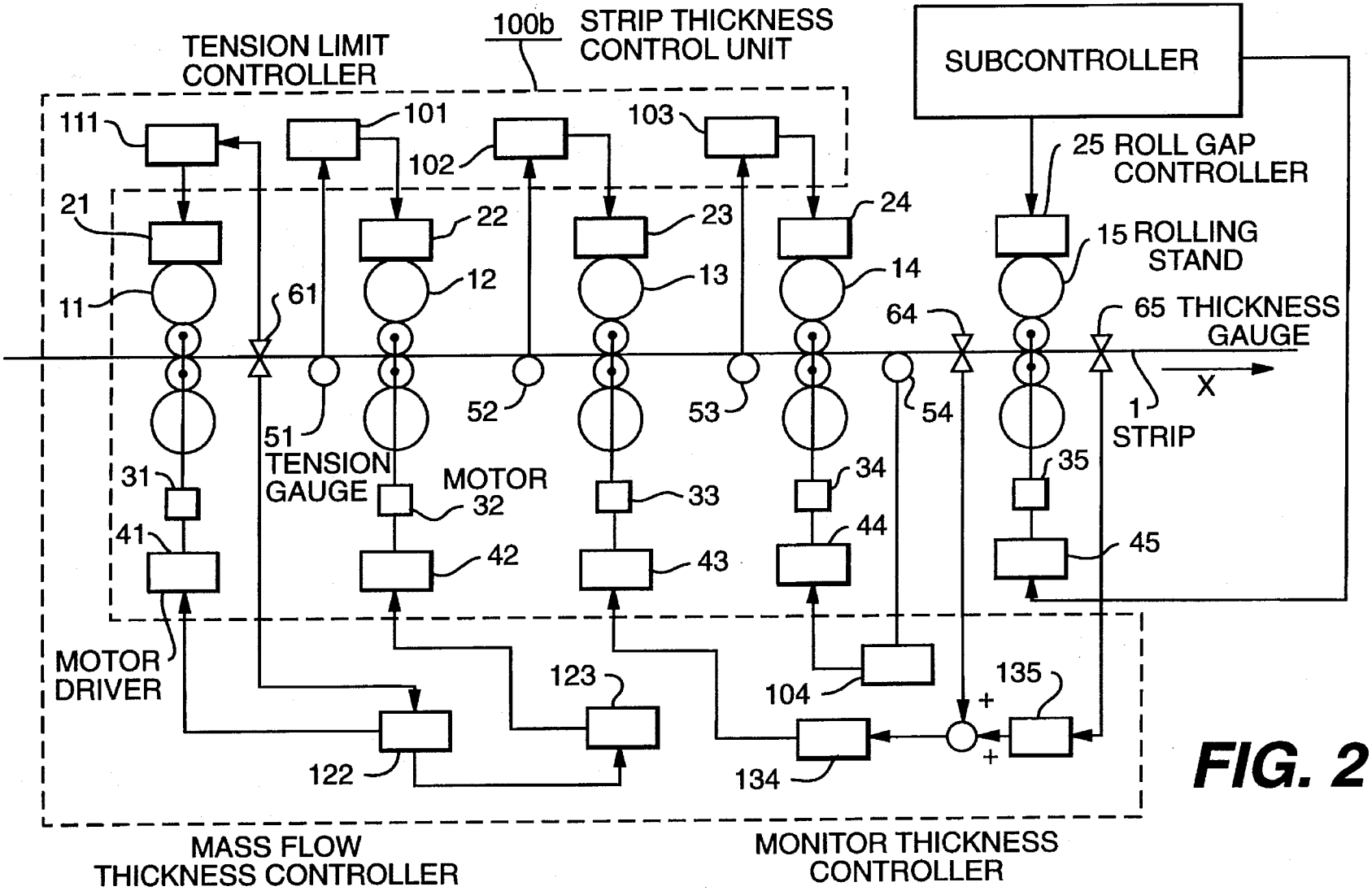
FIG. 2 is a block diagram showing a system for controlling a thickness of a strip being rolled by a rolling mill according to the invention.

FIG.2 is a block diagram showing the structure of an embodiment of the present invention together with the rolling system. In the drawing, those elements which are the same as in FIG.1 are allocated the same symbols, and these will not be explained again.

Here, each stand 11–15 is equipped respectively with roll gap controller 21–25 for controlling the roll gaps, and motor driver 41–45 to drive and control the electric motors 31–35, which are linked respectively to the rolling stands. Of these, the controller 25 and the motor driver 45 belonging to the final rolling stand 15 control the position of the roll and the electric motor in accordance only with the rolling schedule. The rolling schedule is determined by a subcontroller independent of the strip thickness control unit **100*b* for controlling strip thickness, with the result that the roll gap and roll speed are maintained at an initially predetermined value. However, the controllers 21–24 and the motor drivers 41–44 belonging to the stands 11–14 are contrived in such a manner that their settings according to the rolling schedule are each corrected during rolling by the amount corrected by the control unit 100*b*** for controlling strip thickness.

For the purpose of executing this correction, tension gauges 51–54 are provided between each of the rolling stands 11–15, while strip thickness gauges 61 and 65 are provided on the outlet sides of the stand 11 and the final stand 15, respectively, the detected values being fed to the control unit **100*b* for controlling strip thickness. The control unit 100*b* is equipped with tension limit controllers 101–103 for controlling the tensile limit. Tension limit controllers 101–103 calculate the amount by which the roll gap is to be corrected according to the values detected by each of the tension gauges 51–53. These values are fed to the controllers 22–24 for controlling roll gap. Tension limit controller 104 for controlling the tensile limit calculates the amount by which the roll gap is to be corrected according to the value detected by the tension gauge 54, and feeds it to the motor driver 44. Monitor thickness controller 111 for controlling strip thickness calculates the amount by which the roll speed is to be corrected according to the values detected by the thickness gauge 61, and feeds it to the controller 21. The mass flow thickness controller 122 for controlling strip thickness calculates the amount by which the roll speed is to be corrected according to the values detected by the same thickness gauge 61, and feeds it to the motor driver 41. The mass flow thickness controller 123 for controlling strip thickness calculates the amount by which the roll speed is to be corrected from the mass flow determined by derivational process from this amount by which the roll speed is to be corrected, and feeds it to the motor driver 42**.

Next, the control unit **100*b* is equipped with a monitor thickness controller 135 for determining the amount by which the strip thickness on the output side of the stand 14 is to be corrected, corresponding to the deviation in strip thickness on the output side of the stand 15, based on the output of the thickness gauge 65 which is located on the output side of the stand 15. Control unit 100*b* is also equipped with a monitor thickness controller 134 which calculates the amount by which the roll speed of the stand 13 is to be corrected so as to approximate the value obtained to zero, based on the amount by which the strip thickness on the output side of the stand 14 is to be corrected and the deviation in strip thickness as detected by the strip thickness gauge 64 which is located on the output side of the stand 14, and feeds it to the motor driver 43**.

The following is a detailed description of the operation of the controller **100*b***.

The controller 101 determines deviation in the tension of the strip between the stands 11 and 12 from the predetermined desired tensile value as detected by the tension gauge 51. It also executes a PI(proportional-integral) calculation with regard to this deviation, and calculates the amount by which the roll gap of the stand 12 is to be corrected, and feeds it to the controller 22.

In the same way, the controller 102 determines deviation in the tension of the strip between the stands 12 and 13 from the predetermined desired tensile value as detected by the tension gauge 52. It also executes a PI calculation with regard to this deviation and calculates the amount by which the roll gap of the stand 13 is to be corrected, and feeds it to the controller 23.

Further, the controller 103 determines deviation in the tension of the strip between the stands 13 and 14 from the predetermined desired tensile value as detected by the tension gauge 53. It also executes a PI calculation with regard to this deviation and calculates the amount by which the roll gap of stand 14 is to be corrected, and feeds it to the controller 24.

The remaining controller 104 determines deviation in the tension of the strip between the stands 14 and 15 from the predetermined desired tensile value as detected by the tension gauge 54. It also executes a PI calculation with regard to this deviation, and calculates the amount by which the roll speed of stand 14 is to be corrected, and feeds it to the motor driver 44.

The monitor thickness controller 111 is input by the deviation in strip thickness as detected by the thickness gauge 61, i.e. the deviation in strip thickness of the strip 1 on the output side of the stand 11 as compared with the desired strip thickness value. It also executes a PI calculation with regard to this deviation, and calculates the amount by which the roll gap of stand 11 is to be corrected, and feeds it to the controller 21.

The mass flow thickness controller 122 is input by the deviation in strip thickness of the strip 1 on the output side of the stand 11 as detected by the thickness gauge 61. It also calculates the thickness on the output side of stand 12 by the fixed mass-flow rule, and calculates, with this thickness as feedback signal, the deviation in strip thickness of the strip 1 on the output side of the stand 12 as compared with the desired strip thickness. And it further executes a PI calculation with regard to this deviation, calculates the amount by which the roll speed of stand 11 is to be corrected, and feeds it to the motor driver 41.

The mass flow thickness controller 123 calculates the thickness on the output side of stand 13 by the fixed mass-flow rule, based on the strip thickness on the output side of strip 12 as calculated by the controller 122, and calculates, with this thickness as feedback signal, the deviation in strip thickness of the strip 1 on the output side of the stand 13 as compared with the desired strip thickness. And it further executes a PI calculation with regard to this deviation, calculates the amount by which the roll speed of stand 12 is to be corrected, and feeds it to the motor driver 42.

The thickness gauge 65 detects deviation in strip thickness of the strip on the output side of the stand 15 as compared with the desired strip thickness, and feeds it to the controller 135 . The controller 135 executes a PI calculation on this deviation in strip thickness, calculates the amount by which the strip thickness on the output side of the stand 14 is to be corrected, and feeds it to the controller 134. The controller 134 is input by the deviation of the strip thickness on the output side of the stand 14 vis-a-vis the desired value as detected by the thickness gauge 64 and the amount by which the strip thickness on the output side of the stand 14 as determined by the controller 135 is to be corrected. And it also executes a PI calculation on the value obtained, calculates the amount by which the roll speed of the stand 13 is to be corrected, and feeds it to the motor driver 43.

By this means it is possible to perform feedback control vis-a-vis deviation in strip thickness of the strip 1 on the output side of the stand 14, i.e. on the input side of the stand 15.

The abovementioned embodiment is described by a cold tandem rolling mill in five-stand configuration, but it can be applied, where the number of stands is greater than two.

As can be understood from the above explanation, the present invention makes it possible, by determining the amount by which the strip thickness is to be corrected on the output side of the penultimate rolling stand corresponding to the deviation in thickness vis-a-vis the desired thickness on the input side of the final rolling stand and by controlling the roll speed of the antepenultimate stand in such a manner as to approximate to zero the value which is obtained by adding the amount by which the strip thickness is to be corrected and the deviation in thickness vis-a-vis the desired thickness value on the output side of the penultimate rolling stand, to suppress any variation in the thickness of the finished strip even if there is deviation in thickness on the input side of the final rolling stand, and at the same time to speed up control response.

What is claimed is:

1. A system for controlling a thickness of a strip being rolled by a rolling mill having more than two rolling stands, a final stand being a matt roll stand and the remaining stands being bright roll stands, in tandem configuration, comprising:

subcontrol means for controlling a rolling speed and a rolling load of the final rolling stand according to a predetermined control schedule;

a plurality of tension gauge means installed between adjacent rolling stands for detecting a tension of the strip;

a plurality of thickness gauge means including at least second thickness gauge means installed on an output side of a penultimate rolling stand, and final thickness gauge means installed on an output side of the final rolling stand, for detecting a deviation in the thickness of the strip from a predetermined value; and thickness control means, connected to each of the tension gauge means and each of the thickness gauge means, for controlling the thickness and the tension of the strip to respective predetermined values by adjusting roll gaps and rolling speeds of each of the rolling stands except the final rolling stand, based on the detected tensions and the detected deviations in the thickness of the strip, the thickness control means including feedback means for adjusting a rolling speed of an antepenultimate rolling stand according to the detected deviation in the thickness of the strip by the second thickness gauge means, said deviation being corrected by a value calculated from the deviation in the thickness of the strip detected by the final thickness gauge, to control the thickness of the strip at the output side of the final rolling stand to the predetermined value;

the feedback means including a first control unit for determining a first corrected amount by which a desired value of a strip thickness on the output side of the penultimate rolling stand is to be corrected according to the deviation in the thickness of the strip detected by the final thickness gauge means, and a second control unit for determining a second corrected amount representing a corrected strip thickness deviation at the penultimate rolling stand and an amount by which the rolling speed of the antepenultimate rolling stand is to be corrected to control the strip thickness at the output side of the penultimate rolling stand to a desired value, based on the deviation in the thickness of the strip detected by the second thickness gauge means and the first corrected amount.

2. A method for controlling a thickness of a strip being rolled by a rolling mill having more than two rolling stands, a final stand being a matt roll stand and the remaining stands being bright roll stands in tandem configuration, comprising the steps of:

controlling a rolling speed and a rolling load of the final rolling stand according to a predetermined control schedule;

detecting tension of the strip between adjacent rolling stands;

detecting a deviation in the thickness of the strip from a predetermined value at least on an output side of a penultimate rolling stand with second thickness gauge means, and on an output side of the final rolling stand with a final thickness gauge means;

controlling the thickness and the tension of the strip to respective predetermined values by adjusting roll gaps and rolling speeds of each of the rolling stands except the final rolling stand, based on the detected tensions and the detected deviations in the thickness of the strip; and adjusting a rolling speed of an antepenultimate rolling stand according to the detected deviation in the thickness on the output side of the penultimate rolling stand corrected by a value calculated from the detected deviation in the thickness on the output side of the final rolling stand to control the thickness of the strip at the output side of the final rolling stand to the predetermined value;

the step of adjusting a rolling speed of an antepenultimate rolling stand including the substep of determining a first corrected amount by which a desired value of a strip thickness on the output side of the penultimate rolling stand is to be corrected according to the detected deviation in the thickness of the strip by the final thickness gauge means, and the substep of determining a second corrected amount representing a corrected strip thickness deviation at the penultimate rolling stand and an amount by which a rolling speed of the antepenultimate rolling stand is to be corrected to control the strip thickness at the at output side of the penultimate rolling stand to a desired value, based on the detected deviation in the thickness of the strip by the second thickness gauge means and the first corrected amount.

* * * * *